United States Patent [19]

Okitsu et al.

[11] Patent Number: 4,957,077

[45] Date of Patent: Sep. 18, 1990

[54] CAMSHAFT DRIVING ARRANGEMENT FOR DOUBLE OVERHEAD CAMSHAFT ENGINE

[75] Inventors: Nobuyuki Okitsu; Masaru Mitsuhashi, both of Yokohama; Yoshio Iwasa, Nagareyama, all of Japan

[73] Assignee: Nissan Motor Co., Ltd., Yokohama, Japan

[21] Appl. No.: 450,696

[22] Filed: Dec. 14, 1989

[30] Foreign Application Priority Data

Dec. 21, 1988 [JP] Japan ..... 63-320594

[51] Int. Cl.[5] ..... F01L 1/02

[52] U.S. Cl. ..... 123/90.31; 123/90.27

[58] Field of Search ..... 123/90.17, 90.27, 90.31, 123/55 VF, 55 VS, 55 VE, 55 V

[56] References Cited

U.S. PATENT DOCUMENTS 4,553,473 11/1985 Ichida et al. ..... 123/90.31
4,716,864 1/1988 Binder ..... 123/90.31
4,729,348 3/1988 Okada et al. ..... 123/90.31
4,750,455 6/1988 Ebesu ..... 123/90.31

FOREIGN PATENT DOCUMENTS 57-210110 12/1982 Japan ..... 123/90.31
63-12808 1/1988 Japan ..... 123/90.31

*Primary Examiner*—David A. Okonsky
*Assistant Examiner*—Weilun Lo
*Attorney, Agent, or Firm*—Pennie & Edmonds

[57] ABSTRACT

A camshaft driving arrangement for a DOHC engine comprises two pairs of cam sprockets, each pair being mounted to each of the camshafts at one end thereof, and two idler gears, each being rotatably mounted to one of the cylinder heads. A first camshaft driving chain drivingly interconnects one of the idler gears and the adjacent pair of the cam sprockets. On the other hand, a second camshaft driving chain drivingly interconnects the other of the idler gears and the other pair of the cam sprockets. The second camshaft driving chains have different running planes which are axially spaced along the axis of the crankshaft.

5 Claims, 4 Drawing Sheets

CAMSHAFT DRIVING ARRANGEMENT FOR DOUBLE OVERHEAD CAMSHAFT ENGINE

BACKGROUND OF THE INVENTION

The present invention relates to a camshaft driving arrangement for a double overhead camshaft (DOHC) engine having two camshafts for opening and closing suction and exhaust valves at each of cylinder heads.

Japanese Patent Publication No. 59-74312 (=U.S. Pat. No. 4,553,473) discloses a camshaft driving arrangement of the prior art as shown in FIG. 5.

Referring to FIG. 5, there is shown a so-called V-type engine in which a cylinder block 1 includes two cylinder banks 1A and 1B angularly disposed to each other. One 1A of the tow cylinder banks has a plurality of cylinders displaced along the axis of a crankshaft 2 from a plurality of cylinders of the other bank 1B. There is provided a sprocket 3 at the end of the crankshaft 2 rotatably mounted to the cylinder block 1. Rotatably mounted to each of cylinder banks 1A and 1B are an intake camshaft 6 for opening and closing intake valves 5 and an exhaust camshaft 8 for opening and closing exhaust valves 7. Two idler gears 11 are rotatably mounted to the cylinder heads 4A and 4B, respectively. Each of the idler gears 11 has a large diameter gear 11A and a small diameter gear 11B. Fixedly mounted to the end of each of the camshafts 6 and 8 is a sprocket 9. Rotation of the crankshaft 2 is transmitted to the large gears 11A of the idler gears 11 through a rubber timing belt 10, causing rotation of the small gears 11B. Subsequently, the rotation of each of the small gears 11B is transmitted to the adjacent sprockets 9 through a chain 12. As a result, the intake camshafts 6 and the exhaust camshafts 8 are rotated synchronously, opening and closing the intake and exhaust valves 5 and 7. A tensioner 13 is used for adjusting the tension of the timing belt 10, and an idler gear 14 for stabilizing or ensuring an engagement of the timing belt 10.

According to this known camshaft driving arrangement, the timing belt 10 drivingly interconnects the sprocket 3 of the crankshaft 2, the large gears 11B of the idler gears 11 and runs through a running plane and this running plane is disposed axially outward with respect to the axis of the crankshaft 2 more than running planes of the two camshaft driving chains 12 are. The running planes of the two chains 12 are disposed in the common plane. This arrangement is disadvantageous in that the timing belt 10 has to be arranged outward the running planes of the camshaft driving chains 12, causing difficulty in reducing the axial dimension of the engine and in increasing assembling efficiency and maintenance efficiency of the idler gears 11 and chains 12.

An object of the present invention is to provide a camshaft driving arrangement which makes much contribution to reduced axial dimension of the engine and improved assembling and maintenance efficiency of idler gears and camshaft driving chains.

SUMMARY OF THE INVENTION

There is provided, according to the present invention, in a DOHC engine having a cylinder block including two cylinder banks angularly disposed to each other, two cylinder heads mounted on the two cylinder banks, respectively, two pairs of camshafts, each pair being rotatably mounted to one of the two cylinder heads, and a crankshaft mounted to the cylinder block, a camshaft driving arrangement comprising:

two pairs of cam sprockets, each pair being mounted to each of the camshafts at one end thereof;

two idler gears, each being rotatably mounted to one of the cylinder heads;

a first camshaft driving chain drivingly interconnecting one of said idler gears and the adjacent pair of said cam sprockets;

a second camshaft driving chain drivingly interconnecting the other of said idler gears and the other pair of said cam sprockets, said second camshaft driving chains having different running planes which are axially spaced along the axis of the crankshaft; and means for drivingly interconnecting the crankshaft and said idler gears.

DETAILED DESCRIPTION OF THE INVENTION

Referring to FIGS. 1 to 4, a preferred embodiment of the present invention will be described.

Figure 1:
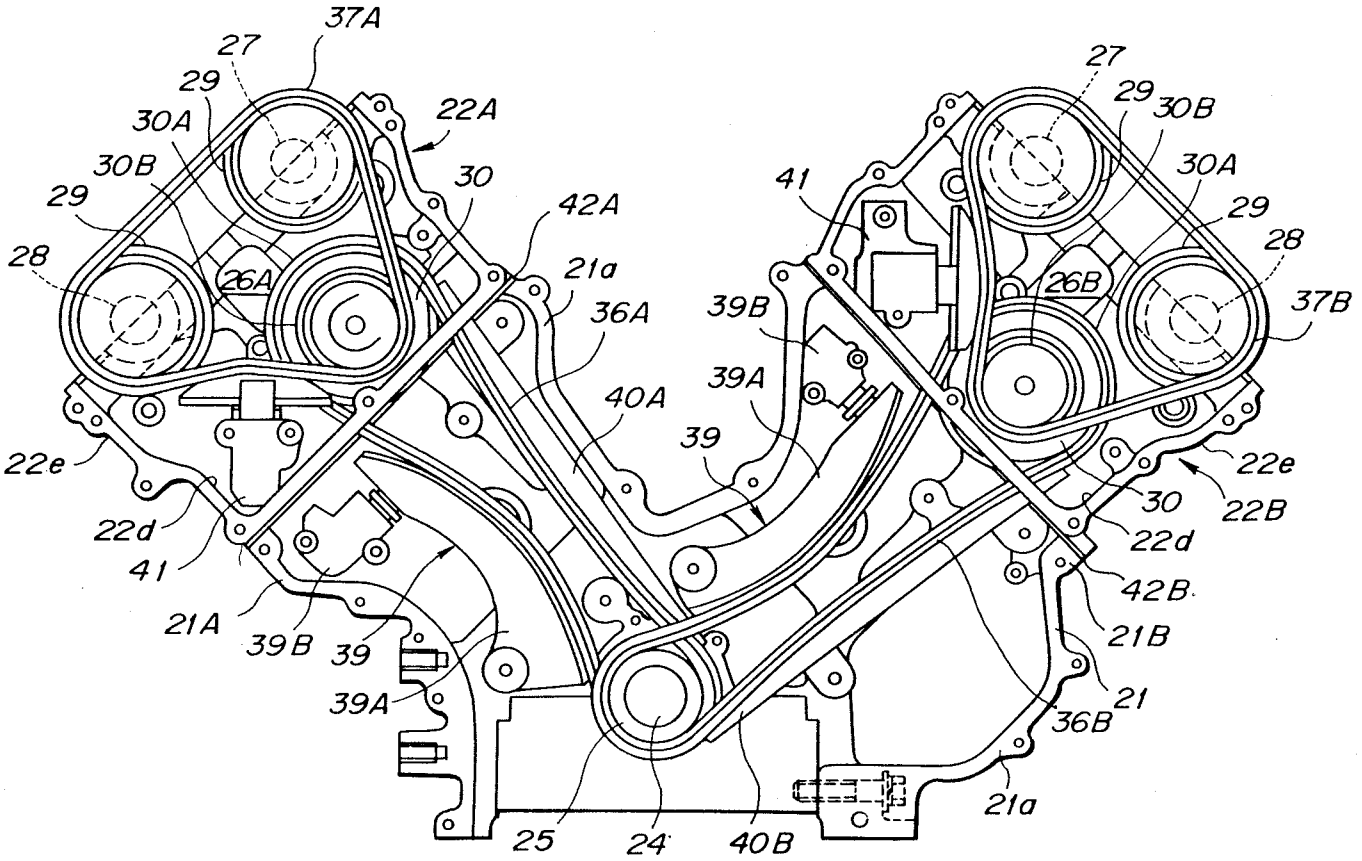
FIG. 1 is an axial end view of a V-type DOHC engine with unnecessary parts removed to show a camshaft driving arrangement.
Figure 2:
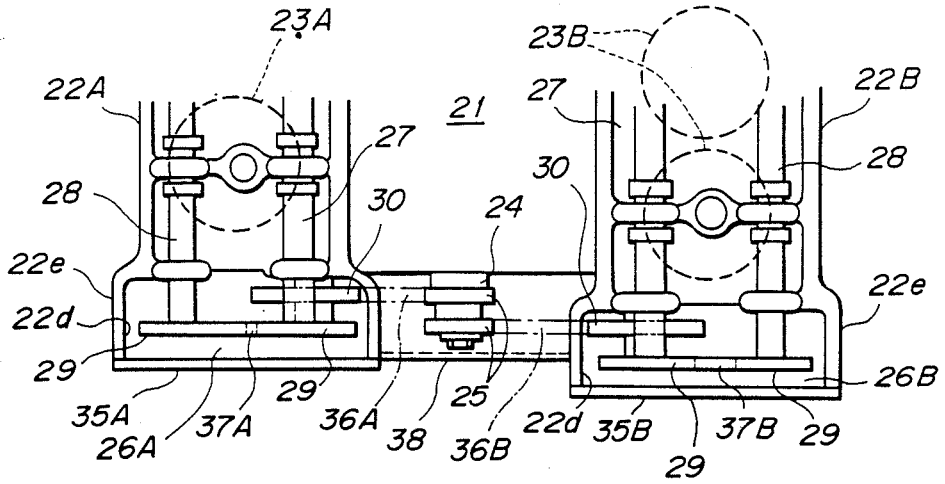
FIG. 2 is a diagrammatic as viewed from the top in FIG. 1.

Referring first to FIG. 1, a cylinder block 21 includes two cylinder banks 21A and 21B angularly disposed to each other. Cylinder heads 22A and 22B are mounted at the top of the cylinder banks 21A and 21B, respectively. One 21A of the two cylinder banks has a plurality of cylinders offset from a plurality of cylinders of the other bank 21B. As best seen in FIG. 2, the cylinders 23B of the cylinder bank 21B are located nearer to the end of the cylinder block 21 than the cylinder 23A of the cylinder bank 23A are.

A crankshaft 24 is rotatably mounted at the bottom of the cylinder block 21. Two crank sprockets 25 are fixedly coupled on the crankshaft 24 on the end portion thereof.

At the longitudinal ends of the cylinder heads 22A and 22B, sprocket chambers 26A and 26B are formed, each being laterally salient and including upper, lower and lateral openings. An intake camshaft 27 and an exhaust camshaft 28 are rotatably mounted to each of the cylinder heads 22A and 22B at the top thereof. The intake camshaft 27 is provided for cyclically opening and closing an intake valves (not shown), and the exhaust camshaft 28 for cyclically opening and closing exhaust valves (not shown). In each of the sprocket chambers 26A and 26B, there is provided a cam sprocket 29 mounted at the end of each of the camshafts 27 and 28.

Figure 3:
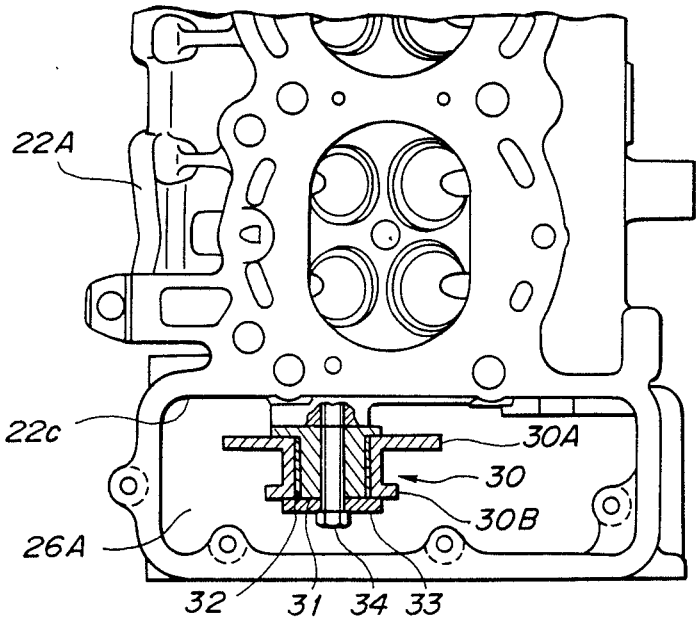
FIG. 3 is an enlarged fragmentary view of FIG. 2.
Figure 4:
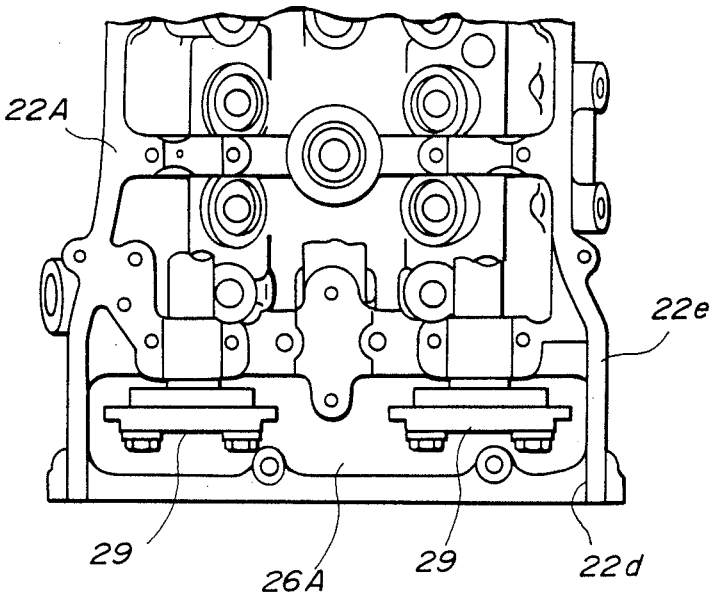
FIG. 4 is another enlarged fragmentary view of FIG. 2.
Figure 5:
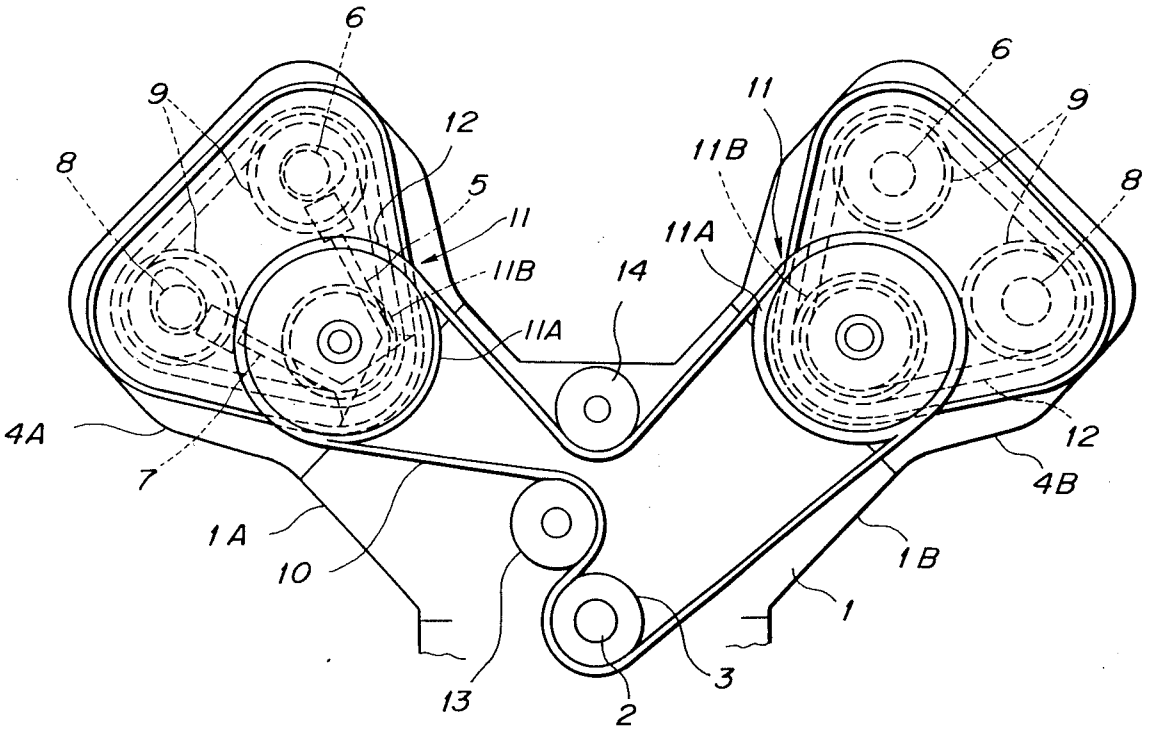
FIG. 5 (PRIOR ART)
FIG. 5 is a view similar to FIG. 1 but showing the known camshaft driving arrangement discussed before.

Two idler gears 30 are rotatably mounted to the cylinder heads 22A and 22B, respectively, at the lower portions thereof. Each of the idler gears 30 includes a larger gear 30A and a small gear 30B which are constructed in monoblock. As shown in FIG. 3, the idler gear 30 is rotatably mounted to a frame 31 through a bearing 32. The frame 31 is attached to an internal wall 22C of each of the sprocket chambers 26A and 26B by a locking bolt 34 with a washer 33. The large gear 30A of the idler gear 30 is so arranged as to be located adjacent the internal wall 22c of each of the sprocket chambers 26A and 26B. As best seen in FIG. 2, sprocket covers 35A and 35B are secured to opened ends of lateral walls 22e of the cylinder heads 22A and 22B respectively, each being in the form of a plate which covers the opening 22d of each of the sprocket chambers 26A and 26B.

A first timing chain 36A drivingly interconnects the large gear 30A of one of the idler gears 30 and one of the crank sprockets 25, whereas a second timing chain 36B the larger gear 30A of the other idler gear 30 and the other crank sprocket 25, At each of the cylinder heads 22A and 22B, one of the camshaft driving chains 37A and 37B drivingly interconnects the adjacent two cam sprockets 29 for the intake and exhaust camshafts 27 and 28 and the small gear 30B of one of the idler gears 30.

The first timing chain 36A and the second timing chain 36B disposed in different running planes which are axially distant along the axis of the crankshaft 24. Additionally, each of the running planes of the camshaft driving chains 37A and 37B of the sprocket chambers 26A and 26B is substantially equidistant from the idler gear 30 of each of the cylinder banks 21A and 21B, and it is positioned on the opposite side of the cylinder block 21 with respect to the idler gear 30. Accordingly, the running plane of the camshaft driving chain 37A of the other sprocket chamber 26a is more distant from the axial end of the cylinder block 21 than that of the camshaft driving chain 37B of the one sprocket chamber 26A.

In order to cover the first and second timing chains 36A and 36B, a single aluminum front cover 38 is attached to the cylinder block 21 at an opened end of a lateral wall 21a (see FIG. 2). At the top of each of the cylinder heads 22A and 22B, there is provided a cam cover (not shown) which covers the intake and exhaust camshafts 27 and 28. Movable tensioners 39 are mounted to the cylinder block 21 for adjusting the tensions of the first and second timing chains 36A and 36B, respectively. Each of the movable tensioners 39 includes a swinging member 39A swingably mounted to the cylinder block 21, and an adjuster 39B for swinging the swinging member 39A. Fixed tensioners 40A and 40B are arranged for the first and second timing chains 36A and 36B, respectively. For adjusting the tensions of the camshaft driving chains 37A and 37B, movable tensioners 41 are mounted to the cylinder heads 22A and 22B, respectively.

The gear ratio of the crank sprocket 25, the large and small gears 30A and 30B of the idler gear 30, and the cam sprocket 29 is so determined that two rotations of the crank shaft 24 cause to the intake and exhaust camshafts 27 and 28 to rotate once. Note that covers 35A, 35B, and 38 are removed in FIG. 1. Reference numerals 42A and 42B designate gaskets.

With such a structure, rotation of the crankshaft 24 is transmitted to the large gear 30A of each of the idler gears 30 through the first and second timing chains 36A and 36B. Subsequently, the rotation of the crankshaft 24 is transmitted from the small gears 30B to the intake and exhaust camshafts 27 and 28 through the camshaft driving chains 37A and 37B, and cam sprockets 29, cyclically opening and closing intake and exhaust valves.

The cylinders 23B of the cylinder bank 21B are disposed nearer the axial end of the cylinder block 21 than the cylinders 23A of the cylinder bank 21A are, and each of the cylinder heads 22A and 22B is provided with a pair of the cam sprockets 29 and the idler gear 30, so that it is possible to mount the sprockets 29, the idler gear 30, and the camshaft driving chains 37A and 37B. This allows a shortening of an overall length of the engine compared to the engine with a conventional timing belt. Additionally, the chains of each of the cylinder banks 21A and 21B are arranged in the same structure, allowing an improvement in the assembling efficiency and the productivity.

The large gear 30A of each of the idler gears 30 is disposed nearer the internal wall 22c of the cylinder heads 22A and 22B than the small gear 30B is. Accordingly, after adjusting the tensions of the first and second timing chains 36a and 36B by means of the movable tensioners 39 and the fixed tensioners 40A and 40B, each of the camshaft driving chains 37A and 37B can be installed for drivingly interconnecting the cam sprockets 29 and the small gear 30B. As a result, it is easy to confirm the coincidence of reference marks between the small gear 30B and each of the camshaft driving chains 37A and 37B, and between the large gear 30A and each of the first and second timing chains 36A and 36B, preventing the assembly error and improving the assembling efficiency.

The idler gears 30, the movable tensioners 39, and the camshaft driving chains 37A and 37B can be disposed through the opening 22d of each of the sprocket chambers 26A and 26B. This opening 22d may be used upon assembly and inspection, resulting in improved productivity. Additionally, since each of the idler gears 30 is attached to the lateral wall 22c of one of the cylinder heads 22A and 22B by the locking bolt 34, it is possible to assemble the idler gears 30 independent of installing the sprocket covers 35A and 35B. This is effective in preventing loosening of bolt and leakage of hydraulic fluid.

What is claimed is:

1. In a DOHC engine having a cylinder block including two cylinder banks angularly disposed to each other, two cylinder heads mounted on the two cylinder banks, respectively, two pairs of camshafts, each pair being rotatably mounted to one of the two cylinder heads, and a crankshaft mounted to the cylinder block, a camshaft driving arrangement comprising:

two pairs of cam sprockets, each pair being mounted to each of the camshafts at one end thereof;

two idler gears, each being rotatably mounted to one of the cylinder heads;

a first camshaft driving chain drivingly interconnecting one of said idler gears and the adjacent pair of said cam sprockets;

a second camshaft driving chain drivingly interconnecting the other of said idler gears and the other pair of said cam sprockets, said first and second camshaft driving chains having different running planes which are axially spaced along the axis of the crankshaft; and means for drivingly interconnecting the crankshaft and said idler gears.

2. A camshaft driving arrangement as claimed in claim 1, wherein said drivingly interconnecting means include two crank sprockets rotatable with the crankshaft and two timing chains, each interconnecting one of said two crank sprockets and the corresponding one of said idler gears.

3. A camshaft driving arrangement as claimed in claim 2, wherein said idler gears include a first gear and a second gear, said first gears of said idler gears being engaged by said first and second timing chains, respectively, said second gears of said idler gears being engaged by said camshaft timing chains, respectively.

4. A camshaft driving arrangement as claimed in claim 3, wherein said second gear of each of said idler gears is disposed axially outward with respect to the crankshaft more than said first gear thereof is.

5. A camshaft driving arrangement as claimed in claim 4, wherein said first gear of each of said idler gears is larger in diameter than said second gear thereof.

* * * * *